US008906301B2

(12) United States Patent
Seeker

(10) Patent No.: US 8,906,301 B2
(45) Date of Patent: Dec. 9, 2014

(54) COMBUSTION CONTROL SYSTEM AND METHOD USING SPATIAL FEEDBACK AND ACOUSTIC FORCINGS OF JETS

(75) Inventor: William Randall Seeker, San Clemente, CA (US)

(73) Assignee: General Electric Company, Schenectady, NY (US)

( * ) Notice: Subject to any disclaimer, the term of this patent is extended or adjusted under 35 U.S.C. 154(b) by 344 days.

(21) Appl. No.: 12/560,406

(22) Filed: Sep. 15, 2009

(65) Prior Publication Data

US 2011/0061575 A1 Mar. 17, 2011

(51) Int. Cl.

| | |
|---|---|
| ***G01N 21/00*** | (2006.01) |
| ***F23N 1/02*** | (2006.01) |
| ***F01K 25/06*** | (2006.01) |
| ***F23N 5/02*** | (2006.01) |
| ***F23N 5/00*** | (2006.01) |

(52) U.S. Cl.

CPC ..... *F23N 5/003* (2013.01); *F23N 2900/05006* (2013.01); *F23N 1/022* (2013.01); *F01K 25/06* (2013.01); *F23N 5/022* (2013.01); *F23N 2900/05002* (2013.01); *F23N 2900/05003* (2013.01); *F23N 2023/04* (2013.01); *F23N 2041/10* (2013.01); *F23C 2201/101* (2013.01)

USPC ..... 422/62

(58) Field of Classification Search

CPC ... F01K 25/06; F23C 2201/101; F23N 1/022; F23N 2023/04; F23N 2041/10; F23N 2900/05002; F23N 2900/05003; F23N 2900/05006; F23N 5/003; F23N 5/022

USPC ..... 422/62

See application file for complete search history.

(56) References Cited

U.S. PATENT DOCUMENTS

| | | | | |
|---|---|---|---|---|
| 4,062,337 | A | 12/1977 | Rivere | |
| 4,697,530 | A | 10/1987 | Marcotte et al. | |
| 4,724,778 | A | 2/1988 | Healy | |
| 4,784,604 | A | 11/1988 | O'Connor | |
| 4,887,958 | A | 12/1989 | Hagar | |
| 5,099,815 | A * | 3/1992 | Yamauchi et al. | 123/472 |
| 5,784,300 | A | 7/1998 | Neumeier et al. | |
| 6,161,376 | A | 12/2000 | Uchikawa | |
| 6,360,680 | B1 | 3/2002 | Breen et al. | |
| 6,401,688 | B2 | 6/2002 | Teraji et al. | |

(Continued)

FOREIGN PATENT DOCUMENTS

| | | | |
|---|---|---|---|
| CN | 1541315 | A | 10/2004 |
| JP | 2001207850 | A | 8/2001 |
| JP | 2007224816 | A | 9/2007 |

OTHER PUBLICATIONS

Cortelezzi, L. et al.; "Actively Controlled Transverse Gas Injection"; IEEE Conference on Decision and Control; Invited Paper CDCOO-INV4905, Dec. 2000.

(Continued)

*Primary Examiner* — Dean Kwak
(74) *Attorney, Agent, or Firm* — Fletcher Yoder, P.C.

(57) ABSTRACT

A system is provided that includes a combustion system having a plurality of jets; a spatial monitoring system with a plurality of sensors disposed in a spatial grid within or downstream from the combustion system; and a control system configured to adjust a forcing frequency of at least one fluid jet in the plurality of fluid jets in response to sensor feedback from the spatial monitoring system.

8 Claims, 6 Drawing Sheets

(56) References Cited

U.S. PATENT DOCUMENTS

| | | | | |
|---|---|---|---|---|
| 6,622,645 | B2 | 9/2003 | Havlena | |
| 7,010,461 | B2 | 3/2006 | Draxton et al. | |
| 7,277,777 | B2 | 10/2007 | Draxton et al. | |
| 7,374,735 | B2 | 5/2008 | Swanson et al. | |
| 7,389,151 | B2 * | 6/2008 | Badami et al. | 700/28 |
| 7,469,077 | B2 | 12/2008 | Xia et al. | |
| 7,469,647 | B2 | 12/2008 | Widmer et al. | |
| 7,475,646 | B2 | 1/2009 | Widmer et al. | |
| 7,504,081 | B2 | 3/2009 | Lissianski et al. | |
| 7,514,052 | B2 | 4/2009 | Lissianski et al. | |
| 8,679,225 | B2 * | 3/2014 | Zanganeh et al. | 95/3 |
| 2004/0191914 | A1 | 9/2004 | Widmer et al. | |
| 2004/0194680 | A1 | 10/2004 | Seeker et al. | |
| 2005/0177340 | A1 | 8/2005 | Draxton et al. | |
| 2005/0279262 | A1 | 12/2005 | Morrison et al. | |
| 2006/0136161 | A1 | 6/2006 | Draxton et al. | |
| 2007/0250215 | A1 | 10/2007 | Jia et al. | |
| 2008/0105175 | A1 | 5/2008 | Booth et al. | |
| 2008/0110381 | A1 | 5/2008 | Swanson et al. | |
| 2008/0283039 | A1 | 11/2008 | Waltz et al. | |
| 2009/0078175 | A1 | 3/2009 | Eiteneer et al. | |

OTHER PUBLICATIONS

Cortelezzi, L. and Karagozian, A. R.; "On the Formation of the Counter-Rotating Vortex Pair in Transverse Jets"; Journal of Fluid Mechanics, vol. 446, pp. 347-373, Nov. 2001.

M'Closkey, R. T.; "The Actively Controlled Jet in Crossflow"; Journal of Fluid Mechanics, vol. 452, No. 1, p. 325, Feb. 2002.

Shapiro, S. R. et al.; "Optimization of Controlled Jets in Crossflow"; AIAA Journal, vol. 44, No. 6, pp. 1292-1298, 2006.

L. S. de B. Alves, et al.; "Linear Stability Analysis of Jets in Cross Flow"; 43rd AIAA Aerospace Sciences Meetin, AIAA Paper AIAA-2005-1118, Jan. 2005.

Megerian, Sevan and Karagozian, Ann; "Evolution of Shear Layer Instabilities in the Transverse Jet"; 43rd AIAA Aerospace Sciences Meeting, AIAA Paper AIAA-2005-0142, Jan. 2005.

Karagozian, Ann R. et al.; "Control of Vorticity Generation in an Acoustically Excited Jet in Crossflow"; 43rd AIAA Aerospace Sciences Meeting, Invited AIAA Paper 2005-0303, Jan. 2005.

Office Action dated Oct. 8, 2013 from corresponding CN Application No. 201010293516.1, along with unofficial English translation.

* cited by examiner

COMBUSTION CONTROL SYSTEM AND METHOD USING SPATIAL FEEDBACK AND ACOUSTIC FORCINGS OF JETS

BACKGROUND OF THE INVENTION

The subject matter disclosed herein relates to combustion systems, and more particularly, to improved combustion and reduced emissions in boilers. Combustion is used in a variety of systems to produce heat and/or power. For example, an engine includes a combustion chamber to generate mechanical power, and a boiler includes a combustion chamber to generate steam. In each system, it is desirable to obtain optimal combustion while minimizing exhaust emissions. As appreciated, a variety of combustion parameters may impact the combustion and exhaust emissions. Unfortunately, existing systems do not adequately account for variations in these combustion parameters throughout the combustion chamber.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a combustion system having a plurality of jets, a spatial monitoring system with a plurality of sensors disposed in a spatial grid within or downstream from the combustion system, and a control system configured to adjust a forcing frequency of at least one fluid jet in the plurality of fluid jets in response to sensor feedback from the spatial monitoring system.

In a second embodiment, a system includes a combustion control system responsive to sensor feedback of at least one parameter at a plurality of positions in a spatial grid within or downstream from a combustion chamber, wherein the combustion control system is configured to adjust jet characteristics based on the sensor feedback, and the jet characteristics include a forcing frequency of at least one fluid jet or a distribution of a jet parameter among a plurality of fluid jets.

In a third embodiment, a method includes sensing at least one of a plurality of parameters with at least one of a plurality of sensors disposed in a spatial monitoring grid in a combustion system. The method also includes receiving feedback from at least one of the plurality of sensors about at least one of the plurality of parameters. The method also includes adjusting a forcing frequency of at least one fluid jet in a plurality of fluid jets in response to the feedback.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
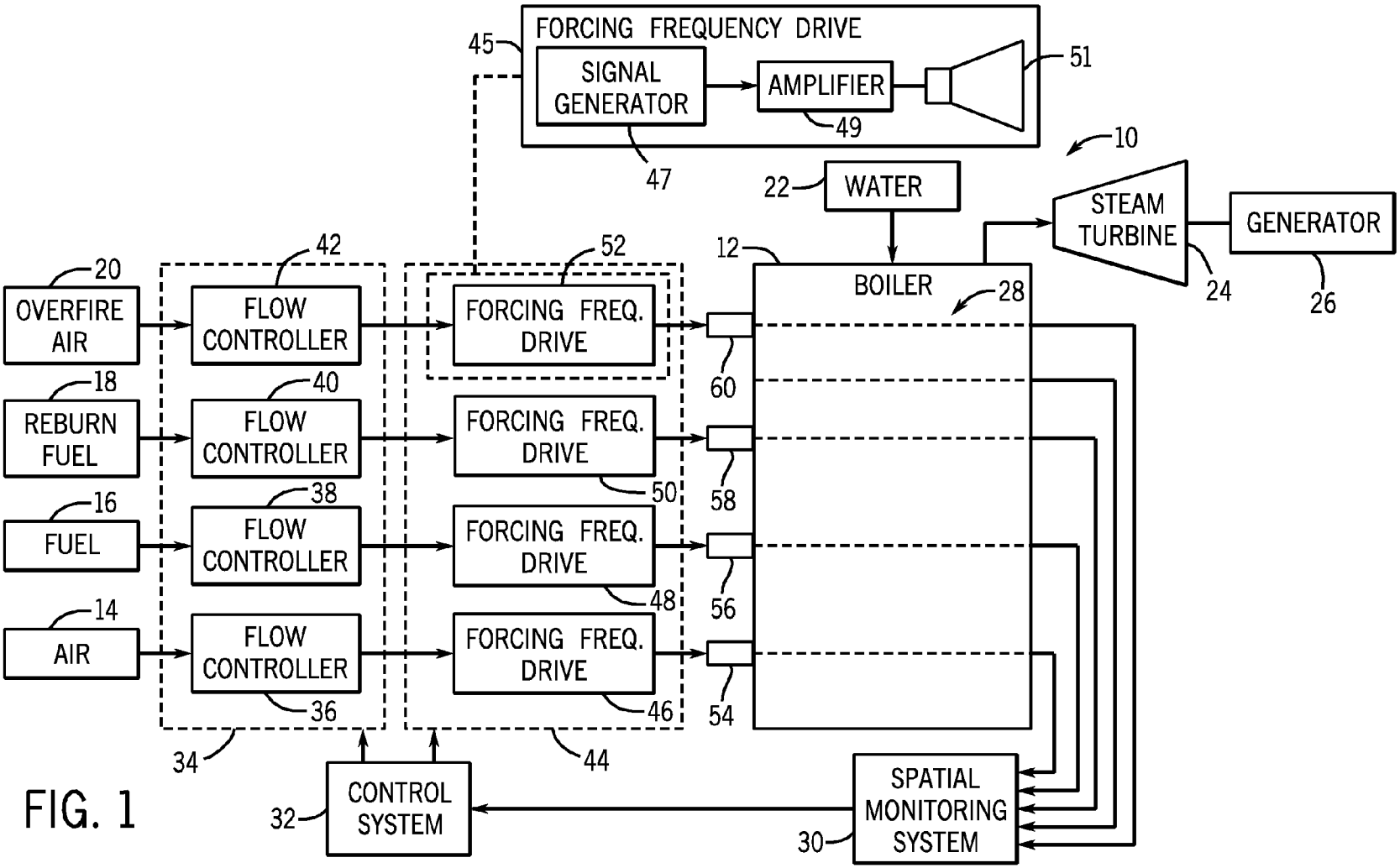
FIG. 1 is a block diagram of a power generation system having a boiler with a spatial monitoring system and a control system, wherein the control system includes acoustic forcing of fluid jets in accordance with embodiments of the present invention.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As discussed below, embodiments of a combustion control system utilize spatial feedback from a spatial monitoring system to control combustion parameters in a spatially effective manner. In other words, the disclosed embodiments may employ closed-loop control by acquiring sensor feedback from a two-dimensional or three-dimensional grid of sensors to identify spatial variations in combustion parameters in a combustion chamber, and then control inputs affecting the combustion parameters in a way that is spatially variable to improve combustion and/or reduce emissions. For example, the spatial grid of sensors may include combustion and emissions sensors, such as temperature sensors, pressure sensors, velocity sensors, nitrogen oxide ($NO_x$) sensors, sulfur oxide ($SO_x$) sensors, carbon oxide ($CO_x$, e.g., CO and $CO_2$) sensors, oxygen ($O_2$) sensors, volatile organic compound (VOC) sensors, total hydrocarbon (THC) sensors, particulate matter (PM) sensors, electrolyte sensors, moisture sensors, $NH_3$ sensors, or any combination thereof. The combustion control system may continuously monitor these sensors or collect data at predefined intervals. In certain embodiments, the combustion control system may perform extractive sampling, and analyze the sampled data in one or more analytical chemical analyzers.

In certain embodiments, the combustion control system may respond to the sensor feedback by independently adjusting a forcing frequency, a flow rate, or both, of one or more fluid jets in a plurality of fluid jets directed into the combustion chamber. These fluid jets may include fuel jets, air jets, or a combination thereof. The independent control of fluid jets selectively enables a uniform or non-uniform distribution of forcing frequencies, flow rates, or both, among the plurality of fluid jets. In this manner, the disclosed embodiments are responsive to spatial variations in combustion parameters, and respond with spatial variations in inputs affecting the combustion parameters. In other words, the spatial variations in inputs may be provided merely with a change in the forcing frequency of one or more fluid jets, or the spatial variations in inputs may be provided by changing the forcing frequency, flow rate, or both, among the plurality of fluid jets (i.e., a non-uniform distribution among jets). As appreciated, the disclosed embodiments may be used in boilers, gas turbine engines, compression ignition engines, spark ignition engines, or any other combustion system. However, in the following discussion, the disclosed embodiments are described and illustrated in the context of a boiler.

As discussed below, embodiments of the present invention provide closed loop feedback control of fluid jets in real-time, which may generally be described as at least less than 5 seconds, less than 2 seconds, or even lesser time. In certain embodiments, the control system may relate sensor feedback from the spatial monitoring system to changes made to individual fluid jet parameters via a preset algorithm. Determining such relationships may allow the control system to learn which settings are optimal to achieve low emissions, uniform combustion conditions, and so forth, in real-time through neural networks. Such learning may also allow the control system to efficiently alter the correct parameters for the correct jet, thereby rapidly achieving optimal combustion and uniformity when an error in one or more preset limits is detected.

Turning now to the drawings, FIG. 1 is a block diagram of an exemplary power generation system 10 that may be used to generate electrical power in accordance with embodiments of the present invention. The power generation system 10 includes a boiler system 12 that burns a mixture of air 14, fuel 16, reburn fuel 18, and overfire air 20 to heat water 22. The water 22 is converted to steam and used to drive a steam turbine 24, which generates electricity in conjunction with a generator 26. The fuel 16 and reburn fuel 18 injected into the boiler system 12 may include coal, gasoline, diesel fuel, oil, natural gas, propane, biomass, and so forth. The fuel 16 and reburn fuel 18 may be the same or different from one another. For example, the fuel 16 may be pulverized coal injected with a carrier gas, while the reburn fuel 18 may be biomass.

The illustrated boiler system 12 includes a spatial monitoring grid 28, which includes a plurality of sensors configured to measure combustion parameters. The combustion parameters may be indicative of combustion performance, uniformity of combustion, emissions, and so forth. For example, the sensors may include combustion and emissions sensors, such as temperature sensors, pressure sensors, velocity sensors, nitrogen oxide ($NO_X$) sensors, sulfur oxide ($SO_X$) sensors, carbon oxide (CO and $CO_2$) sensors, oxygen ($O_2$) sensors, volatile organic compound (VOC) sensors, total hydrocarbon (THC) sensors, particulate matter (PM) sensors, moisture sensors, electrolyte sensors, or any combination thereof. In certain embodiments, the spatial monitoring grid 28 includes any number of each type of sensor in a two-dimensional or three-dimensional grid. In FIG. 1, each horizontal dashed line within the boiler system 12 represents a two-dimensional grid of sensors. Altogether, these multiple two-dimensional grids represent a three-dimensional grid of sensors within the boiler system 12. The sensors may be distributed with uniform or non-uniform spacing throughout the boiler system 12. For example, the sensors may be spaced closer together in areas of high variability, while being spaced farther apart in areas of less variability. Likewise, the sensors may be arranged in a variety of patterns depending on the boiler design, combustion characteristics, and so forth. For example, the sensors may be arranged in a matrix pattern (e.g., parallel rows and columns), a checkerboard pattern (e.g., staggered rows and columns), a ring-shaped pattern (e.g., concentric rings of multiple sensors), or any other suitable pattern.

In the illustrated embodiment, each sensor in the spatial monitoring grid 28 obtains data regarding a measured parameter, such as a level of carbon monoxide or oxygen, at the particular spatial location where the sensor is located and then communicates these data to a spatial monitoring system 30. In some embodiments, the spatial monitoring system 30 electronically receives, stores, and processes such data from the plurality of sensors disposed in the spatial monitoring grid 28. That is, the spatial monitoring system 30 receives a distinct signal from each sensor in the spatial monitoring grid 28 indicative of a combustion characteristic at the location of the sensor. To that end, the spatial monitoring system 30 may include volatile or non-volatile memory, such as read only memory (ROM), random access memory (RAM), magnetic storage memory, optical storage memory, or a combination thereof. Furthermore, a variety of control parameters may be stored in the memory along with code configured to provide a specific output. For instance, the spatial monitoring system 30 may be programmed to acquire and time stamp sensor data at a first frequency and output data to a control system 32 at a second frequency. As appreciated, the first and second frequencies may be the same or different from one another, and may vary depending on the application and specific design considerations. However, any suitable frequencies may be used for the first and second frequencies.

In certain embodiments, the control system 32 may receive outputs from the spatial monitoring system 30 at predetermined time intervals or in real-time. The control system 32 may include memory, such as ROM, RAM, magnetic storage memory, optical storage memory, or a combination thereof, to store either the entirety or a subset of the received data. For instance, in some embodiments, the control system 32 may only store data from the most recent sensor measurements (e.g., data may only be stored for the prior 30 minutes), thus eliminating historical data from its memory as more recent data becomes available. In such embodiments, the control system 32 may be configured to access historical data stored in the memory of the spatial monitoring system 30 as necessary. In other embodiments, the control system 32 may retain all or a larger amount of historical data as a baseline for controlling the boiler system 12.

In the illustrated embodiment, the control system 32 is coupled to a flow controller set 34 including independent flow controllers 36, 38, 40, and 42 (e.g., valves), wherein the control system 32 is configured to independently control fluid flow associated with the air 14, the fuel 16, the reburn fuel 18, and the overfire air 20 based on spatial feedback from the spatial monitoring system 30. In addition, the control system 32 is coupled to a forcing frequency drive set 44 (e.g., acoustic speakers, amplifiers, and signal generators) including independent forcing frequency drives 46, 48, 50, and 52, wherein the control system 32 is configured to independently control the forcing frequency associated with the air 14, the fuel 16, the reburn fuel 18, and the overfire air 20 based on spatial feedback from the spatial monitoring system 30. In turn, the illustrated embodiment includes an air jet 54, a fuel jet 56, a reburn fuel jet 58, and an overfire air jet 60. In certain embodiments, each jet 54, 56, 58, and 60 may represent a single jet or a plurality of jets distributed about the boiler system 12. The air jet 54 (or set of air jets) receives the air 14 flowing along an airflow path having the flow controller 36 and the forcing frequency drive 46. The fuel jet 56 (or set of fuel jets) receives the fuel 16 flowing along a fuel flow path having the flow controller 38 and the forcing frequency drive 48. The reburn fuel jet 58 (or set of reburn fuel jets) receives the reburn fuel 18 flowing along a reburn fuel flow path having the flow controller 40 and the forcing frequency drive 50. The overfire air jet 60 (or set of overfire air jets) receives the overfire air 20 flowing along an overfire airflow path having the flow controller 42 and the forcing frequency drive 52.

The control system 32 controls operational characteristics of the fluid jets 54, 56, 58, and 60 (or sets of fluid jets) based on spatial feedback from the spatial monitoring system 30, baseline parameters, preset limits, historical data, and so forth. As discussed in further detail below, the control system 32 employs closed-loop control to vary the fluid flow rate and/or the forcing frequency of the fluid jets 54, 56, 58, and 60 in a uniform manner or a non-uniform manner depending on the spatial feedback. For example, the control system 32 may respond to spatial variations in combustion sensor feedback (e.g., temperature or exhaust emissions) by uniformly increasing or decreasing the flow rate and/or forcing frequency of air 14, fuel 16, reburn fuel 18, and/or overfire air 20 through all jets 54, 56, 58, and 60 to alter the fuel/air ratio, the fuel/air mixing, and other characteristics. By further example, the control system 32 may respond to spatial variations in combustion sensor feedback (e.g., temperature or exhaust emissions) by independently increasing or decreasing the flow rate and/or forcing frequency of air 14, fuel 16, reburn fuel 18, and/or overfire air 20 through each individual jet 54, 56, 58, and 60 in a non-uniform manner, thereby tailoring the response to the spatial variations. The independent control of each individual jet 54, 56, 58, and 60 (e.g., flow rate and forcing frequency) substantially improves the distribution and mixing of fuel and air throughout the combustion zone, thereby providing a more uniform fuel/air mixture for improved combustion and reduced emissions. For example, the independent control of each individual jet 54, 56, 58, and 60 (e.g., flow rate and forcing frequency) can substantially reduce pockets of undesirably low fuel/air mixtures or undesirably high fuel/air mixtures. Thus, the combination of spatial feedback and spatially adjustable characteristics of fluid jets 54, 56, 58, and 60 modifies the combustion process in the boiler system 12.

The control system 32 may perform a variety of analyses based on the spatial feedback from the spatial monitoring system 30. For example, the control system 32 may identify trends in both time and space in each monitored combustion parameter. By further example, the control system 32 may identify combustion parameters that are gradually increasing or decreasing in a spatial region relative to surrounding spatial regions. The control system 32 also may correlate multiple combustion parameters with one another at each spatial position in the spatial monitoring grid 28, and compare these correlations at each spatial position across the entire grid. Again, the control system 32 may perform a variety of analyses to establish suitable flow rates and forcing frequencies associated with the jets 54, 56, 58, and 60.

As further illustrated, an exemplary embodiment of a forcing frequency drive 45 may include a signal generator 47, an amplifier 49, and an acoustic horn 51 or speaker. The signal generator 47 is configured to generate a periodic waveform signal having a period or frequency, which is variable in response to control by the control system 32. The amplifier 49 is configured to adjust the amplitude of the periodic waveform signal, e.g., increase or decrease the amplitude, in response to control by the control system 32. The horn 51 is configured to output the periodic waveform signal at the desired amplitude to create a sound wave, which is configured to acoustically force the expelled fluid flow to change shape, size, or mixing characteristics. In particular, the sound wave may induce the formation of large scale structures (e.g., vortices) downstream of the jet, thereby improving mixing and spatial impact of the fluid jet. As appreciated, each illustrated forcing frequency drive 46, 48, 50, and 52 in the set 44 may have a similar construction as the forcing frequency drive 45.

In certain embodiments, the control system 32 may adjust the forcing frequency drive 45 (i.e., each drive 46, 48, 50, and 52) to generate a forcing frequency of any value, or between any suitable upper and lower limits. For example, the forcing frequency may range between approximately 0 to 1000 Hertz, 10 to 500 Hertz, or 100 to 400 Hertz. Again, the control system 32 may independently adjust the forcing frequency of each drive 46, 48, 50, and 52 to vary the large scale structures, shapes, and mixing associated with fluid expelled from each respective jet 54, 56, 58, and 60. For example, the control system 32 may continuously or incrementally adjust the forcing frequency of one forcing frequency drive 46, 48, 50, or 52 at a time, or adjust multiple drives in unison. In an embodiment using continuous adjustments, the forcing frequency may gradually change the forcing frequency to any suitable value, but not limited to incremental changes. In an embodiment using incremental adjustments, the control system 32 may adjust the forcing frequency in any suitable increments, such as increments of 1, 5, 10, 15, 20, 25, 30, 40, or 50 Hertz. Furthermore, the control system 32 may increase or decrease the amplitude of the forcing frequency via the amplifier 49.

As discussed in detail above, the forcing frequency drive 45 in the illustrated embodiment includes the signal generator 47, the amplifier 49, and the speaker 51. However, in other embodiments, the forcing frequency drive 45 may include other components that force the expelled fluid flow to change shape, size, or mixing characteristics. For example, the forcing frequency drive 45 may include any components that are configured to vibrate or modulate fluid flow at a desired frequency of change. For instance, in one embodiment, vibrating valves may be used to vibrate the fluid flow at a desired frequency. In another embodiment, the pressure of the fluid flow may be pulsed at a desired frequency. In such embodiments, the forcing frequency drive 45 may include valves, pulsation mechanisms, vibration mechanisms, and/or modulation mechanisms configured to change the acoustic properties of the fluid flow.

Figure 2:
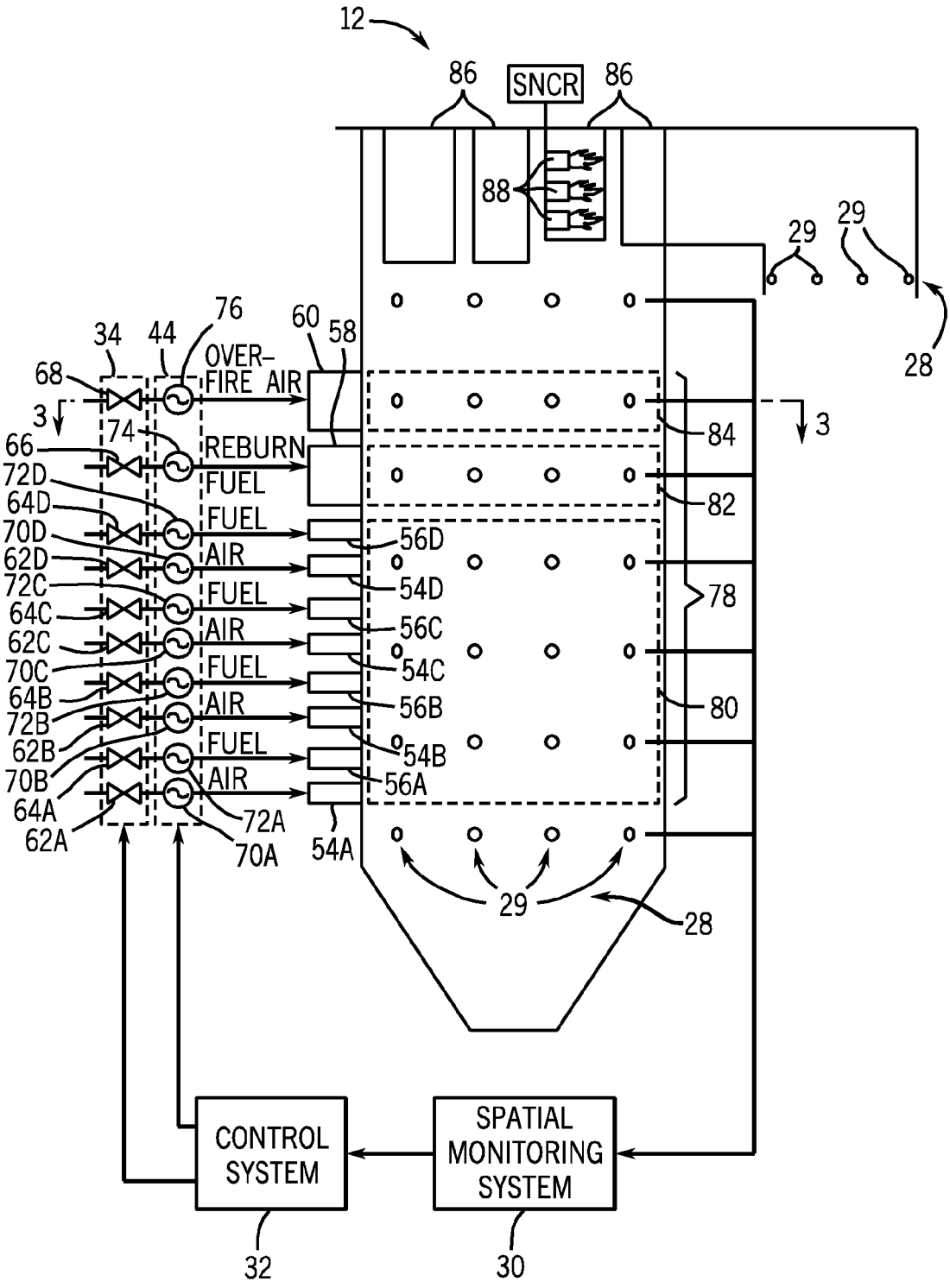
FIG. 2 is a diagram of a boiler having acoustic forcing of fuel and air jets in response to feedback from a spatial monitoring system in accordance with embodiments of the present invention.

FIG. 2 is a diagram of an embodiment of the boiler system 12 of FIG. 1, illustrating closed-loop feedback control of flow controller set 34 and forcing frequency drive set 44 in response to spatial feedback from multiple sensors in the spatial monitoring grid 28. In the illustrated embodiment, the sensors 29 are arranged in a three-dimensional grid in the boiler system 12 and are configured to measure spatial variations and temporal variations in combustion parameters (e.g., temperature, emissions, etc.) throughout the boiler system 12. Each sensor 29 outputs data to the spatial monitoring system 30 to allow for dynamic control of the jets 54, 56, 58, and 60 via the control system 32 in real-time as previously described. Thus, the control system 32 operates in a closed-loop using spatial data from the spatial monitoring system 30 to independently adjust operational characteristics (e.g., forcing frequency, forcing amplitude, flow rate, etc.) of the jets 54, 56, 58, and 60 to improve the combustion performance and reduce emissions.

In the illustrated embodiment, each air jet 54A, 54B, 54C, or 54D is associated with a distinct flow controller 62A, 62B, 62C, or 62D (e.g., valve) that is configured to control the amount of air flow that will ultimately reach the boiler system 12. For example, the amount of air flow through air jet 54A is controlled by the valve 62A, which receives a distinct signal from the control system 32. Similarly, the amount of air flow through air jets 54B, 54C, and 54D is independently controlled by respective valves 62B, 62C, and 62D, which receive distinct signals from the control system 32. Similarly, in the illustrated embodiment, each fuel jet 56A, 56B, 56C, or 56D is associated with a distinct valve 64A, 64B, 64C, or 64D that is configured to control the amount of fuel flow that will ultimately reach the boiler system 12. For instance, the amount of fuel flow through fuel jet 56A is controlled by the valve 64A, which receives a distinct signal from the control system 32. Similarly, the amount of fuel flow through fuel jet 56B, 56C, and 56D is independently controlled by respective valves 64B, 64C, and 64D, which receive distinct signals from the control system 32. In addition, reburn fuel jet 58 is associated with a valve 66 that is configured to control the amount of reburn fuel flow that will ultimately reach the boiler system 12. Likewise, overfire air jet 60 is associated with a valve 68 that is configured to control the amount of overfire air flow that will ultimately reach the boiler system 12. Again, the valves 66 and 68 are responsive to distinct signals from the control system 32.

In the illustrated embodiment, each air jet 54A, 54B, 54C, or 54D is also associated with a distinct acoustic forcing device (e.g., acoustic horn) 70A, 70B, 70C, or 70D that is configured to control the forcing frequency and amplitude of the air flow that will ultimately reach the boiler system 12. For example, the forcing frequency and amplitude of the air flow through air jet 54A is controlled by the acoustic forcing device 70A, which receives a distinct signal from the control system 32. Similarly, in the illustrated embodiment, each fuel jet 56A, 56B, 56C, or 56D is associated with an acoustic forcing device 72A, 72B, 72C, or 72D that is configured to control the forcing frequency and amplitude of the fuel flow that will ultimately reach the boiler system 12. For instance, the forcing frequency and amplitude of fuel flow through fuel jet 56A is controlled by the acoustic forcing device 72A, which receives a distinct signal from the control system 32. Similarly, reburn fuel jet 58 is associated with an acoustic forcing device 74 that is configured to control the forcing frequency of the reburn fuel flow that will ultimately reach the boiler system 12. Also, overfire air jet 60 is associated with an acoustic forcing device 76 that is configured to control the forcing frequency and amplitude of the overfire air flow that will ultimately reach the boiler system 12.

The boiler system 12 receives fuel and air inputs via the jets 54, 56, 58, and 60 into a combustion zone 78. In the illustrated embodiment, the combustion zone 78 includes a primary combustion zone 80, a reburning zone 82, and a burnout zone 84. However, it should be noted that in other embodiments, the combustion zone 78 may not include the reburning zone 82 and/or the burnout zone 84. The primary combustion zone 80 receives, mixes, and combusts the primary fuel/air mixture of fuel 16 and air 14, thereby creating hot products of combustion (e.g., gas, particulate matter, etc). These products of combustion may include sulfur oxides ($SO_x$), nitrogen oxides ($NO_x$), carbon oxides ($CO_x$, e.g., CO and CO2), carbon, water, nitrogen, sulfur, and mercury, among other products. The reburning zone 82 and/or the burnout zone 84 may be used to reduce undesirable exhaust emissions, such as $NO_x$. The reburning zone 82 is typically rich in fuel, thus reducing the amount of carbon combusted in the fuel and creating a more reactive environment compared to systems without a reburning zone 82. The burnout zone 84 contains overfire air 20, which facilitates the reduction of undesirable combustion gas byproducts as compared to systems without a burnout zone 84. In the illustrated embodiment, combustion gases generally flow in a downstream direction from the primary combustion zone 80 upwardly to the reburning zone 82, and then upwardly from the reburning zone 82 to the burnout zone 84.

Combustion gases exit the combustion zone 78 downstream of the burnout zone 84, and then flow along heat exchangers 86 and selective non-catalytic reduction (SNCR) jets 88. The heat exchangers 86 are configured to transfer heat from the hot products of combustion to a fluid (e.g., water 22) to generate a heated fluid (e.g., steam). The heated fluid (e.g., steam) may then be used to generate power in the steam turbine 24 coupled to the generator 26, as discussed above with reference to FIG. 1. The SNCR jets 88 are configured to inject selective reducing agents to reduce undesirable emissions (e.g., $NO_X$) in the boiler system 12. For example, the selective reducing agents may include a variety of chemical species capable of selectively reducing $NO_X$ in the presence of oxygen in a combustion system. In certain embodiments, the selective reducing agents may include urea, ammonia, cyanuric acid, hydrazine, thanolamine, biuret, triuret, ammelide, and so forth.

Figure 3:
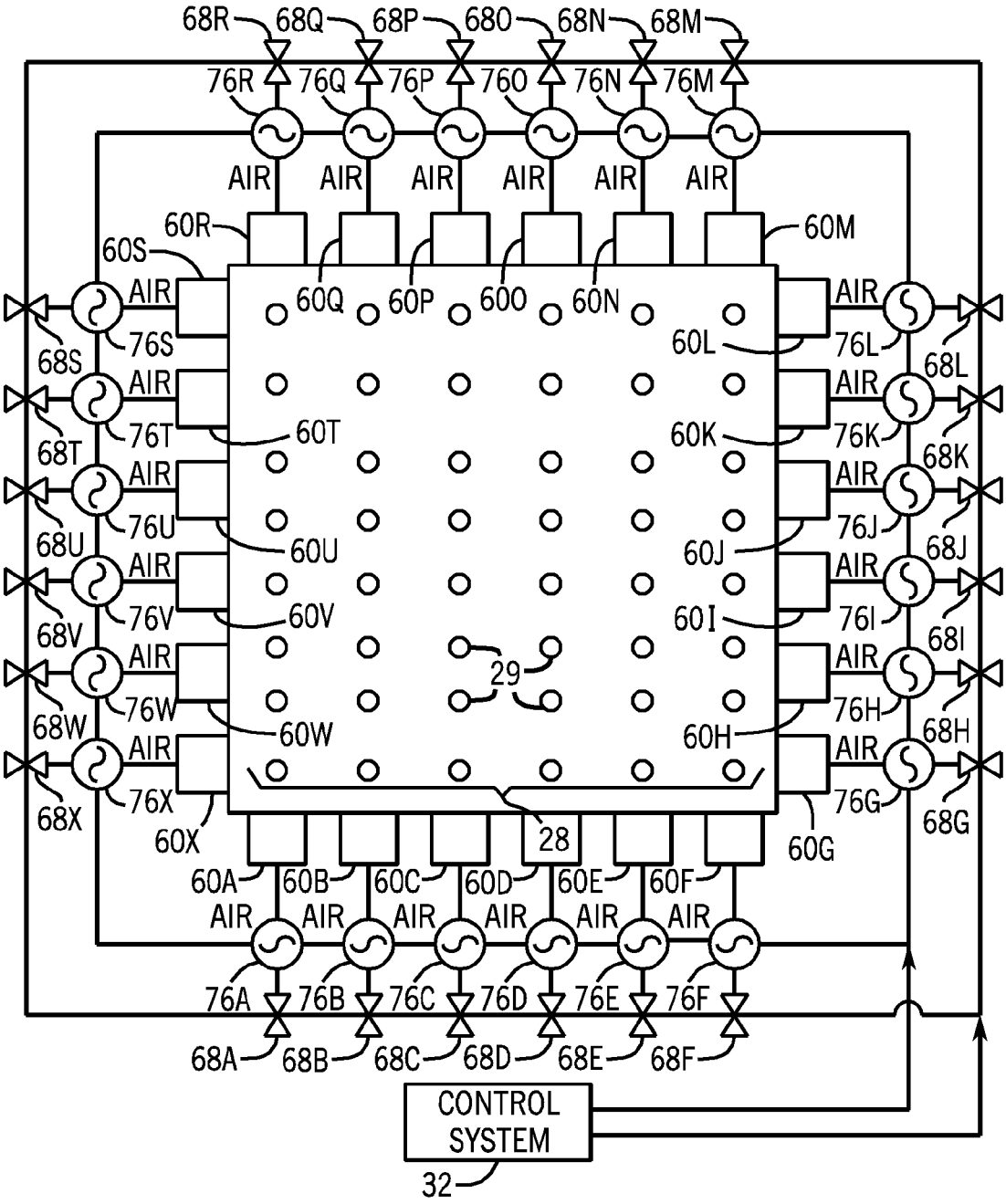
FIG. 3 is a cross-sectional view of a boiler taken along line 3-3 of FIG. 2, illustrating a sensor grid of the spatial monitoring system and an acoustically forced jet arrangement in accordance with embodiments of the present invention.

As illustrated in FIG. 3, the spatial monitoring grid 28 may include grids of sensors 29 disposed upstream, within, and downstream of the combustion zone 78. For example, the spatial monitoring grid 28 may include at least one grid of sensors 29 in the primary combustion zone 80, at least one grid of sensors 29 in the reburning zone 82, and at least one grid of sensors 29 in the burnout zone 84. Each grid of sensors 29 may include any number of sensors of various types. For example, each grid of sensors 29 may include 500 temperature sensors, 500 $NO_X$ sensors, 500 $SO_X$ sensors, 500 CO sensors, 500 $CO_2$ sensors, and so forth. Thus, each location on each grid may include any number of different sensor types. In this manner, the spatial monitoring grid 28 provides a spatial indication of combustion performance and exhaust emissions. In turn, the spatial monitoring system 30 communicates this spatial data to the control system 32, which controls the fuel and air jets 54, 56, 58, and 60 in a way tailored to the spatial data. In other words, if the spatial data indicates a need for more air in a particular region, then the control system 32 may independently control the air flow rate of a suitable air jet 54 and/or 60 to increase the concentration of air in that particular region. Likewise, if the spatial data indicates a need for more fuel in a particular region, then the control system 32 may independently control the fuel flow rate of a suitable fuel jet 56 and/or 58 to increase the concentration of fuel in that particular region. Finally, if the spatial data indicates a need for more mixing in a particular region, then the control system 32 may independently control a forcing frequency and/or forcing amplitude of a suitable jet 54, 56, 58, and/or 60 to increase the large scale structures (e.g., vortices) in that particular region. The independent control of fuel jets may include different axial positions, circumferential positions, radial positions, or any combination thereof.

FIG. 3 is a cross-sectional view of the boiler system 12 taken along line 3-3 of FIG. 2, illustrating a pattern of sensors 29 in the spatial monitoring grid 28 and an arrangement of overfire air jets 60 (e.g., jets 60A through 60X) disposed about the boiler system 12. As illustrated, each overfire air jet 60 is coupled to a respective forcing frequency drive 76 (e.g., drives 76A through 76X) and a respective flow controller 68 (e.g., valves 68A through 68X), all of which are adjustable via independent control signals from the control system 32.

As illustrated, the spatial monitoring grid 28 includes sensors 29 that extend crosswise through the interior of the boiler system 12. In certain embodiments, the sensors 29 are equally spaced throughout the interior of the boiler system 12, e.g., across a two-dimensional plane or a three-dimensional space. For example, the spatial monitoring grid 28 may space the sensors 29 at an offset of approximately 5 mm to 5 cm relative to one another depending on the size and design of the boiler system 12. Likewise, depending on the application, the boiler system 12 may include between approximately 1 and 100 overfire air jets 60 disposed about the burnout zone 84. In the illustrated plane, the boiler system 12 includes 24 overfire air jets 60 (e.g., six per wall, but not intending to limit the invention) disposed about the burnout zone 84. However, any suitable number or arrangement of jets 60 may be employed in the boiler system 12.

In operation, the control system 32 receives spatial combustion data (e.g., temperature, emissions levels, etc.) from the sensors 29 in the grid 28, and actively responds to this spatial combustion data to independently control the overfire air jets 60. Again, the independent control may include variations in the forcing frequency, forcing amplitude, and flow rate of one or more overfire air jets 60, thereby changing the spatial impact of these overfire air jets 60 on the combustion process. For example, the control system 32 may actively adjust only the overfire air jets 60 adjacent to a region with an undesirable combustion parameter (e.g., high emissions levels), while not adjusting the other overfire air jets 60. In particular, the control system 32 may adjust the forcing frequency, amplitude, and flow rate of each air jet 60 to change the shape, size, penetration, and mixing characteristics of the injected overfire air in response to spatial data surrounding the particular air jet 60. For example, if the spatial combustion data indicates a need for deeper penetration of the overfire air jet 60, then the control system 12 may increase the flow rate via valve 68. By further example, if the spatial combustion data indicates a need for increased mixing in a particular region, then the control system 12 may adjust the forcing frequency and amplitude to cause greater mixing via the forcing frequency drive 76. As appreciated, the control scenarios are virtually endless, as the control system 12 is configured to independently control flow rate, forcing frequency, and forcing amplitude of each jet 60 alone or in combination with one another based on the spatial combustion data. Thus, by virtue of the independent control, the control system 12 is able to adjust the spatial distribution of these jet characteristics (e.g., flow rate, frequency, and amplitude) among the plurality of jets 60.

Although FIG. 3 illustrates overfire jets 60 and sensors 29 in the burnout zone 84, a similar arrangement of jets 54, 56, and 58 and sensors 29 may be employed in the primary combustion zone 80 and the reburning zone 82. For example, the control system 32 may adjust the forcing frequency, forcing amplitude, and flow rate of the other jets 54, 56, and 58 throughout the combustion zone 78 in response to the spatial combustion data. Again, by virtue of the independent control, the control system 12 is able to adjust the spatial distribution of these jet characteristics (e.g., flow rate, frequency, and amplitude) among the plurality of jets 54, 56, and 58.

Figure 4:
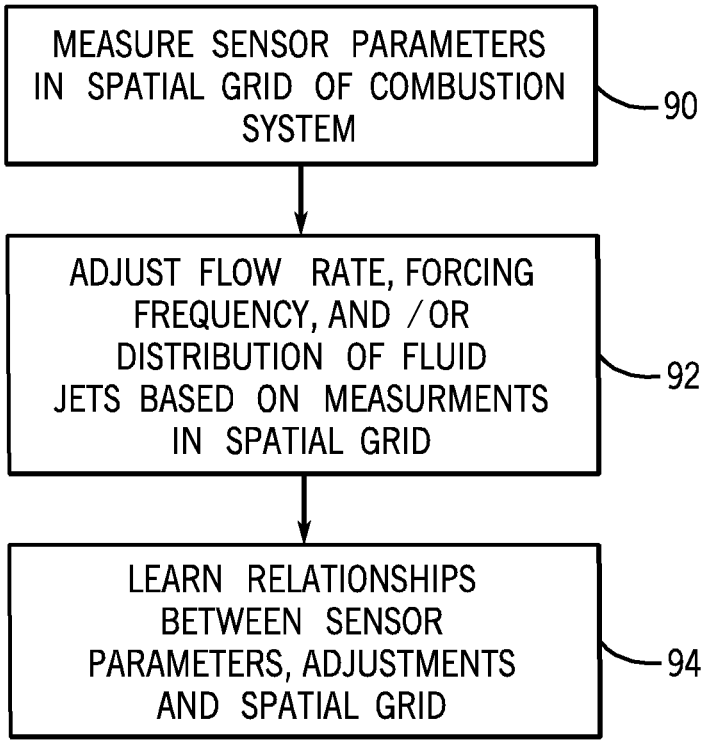
FIG. 4 is a flow chart of a process of controlling combustion and emissions by adjusting fluid jets (e.g., acoustic forcing) based on feedback from a spatial grid of sensors in accordance with aspects of the present invention.

FIG. 4 is a flow chart of a process of controlling combustion and emissions by adjusting fluid jets (e.g., acoustic forcing) based on feedback from a spatial grid of sensors in accordance with aspects of the present invention. For example, the blocks of FIG. 4 represent exemplary logic that may be stored and executed with the control system 32 and the spatial monitoring system 30. First, sensors 29 in the spatial monitoring grid 28 measure parameters in the boiler system 12, as represented by block 90. These parameters are communicated to the spatial monitoring system 30, which provides spatial combustion data to the control system 32 in real-time. The control system 32 collects and analyzes the spatial combustion data from various locations in the boiler system 12 and adjusts the flow rate, forcing frequency, forcing amplitude, and/or distribution of active fluid jets, as represented by block 92. In certain embodiments, the control system 32 may relate sensor feedback received from the spatial monitoring system 30 to changes made to individual fluid jet parameters via a preset algorithm. In this way, the control system 32 may learn relationships between sensor parameters, adjustments made, and the spatial monitoring grid 28, as represented by block 94. That is, the control system 32 may learn the settings to be employed to achieve low emissions and/or uniform combustion in the combustion zone 78 of the boiler system 12. Such learning may therefore allow the control system 32 to efficiently alter the correct parameters for the correct jet. A technical effect of this learning includes the ability to rapidly improve the combustion and uniformity upon detection of deviations from the desirable value of one or more parameters.

Figure 5:
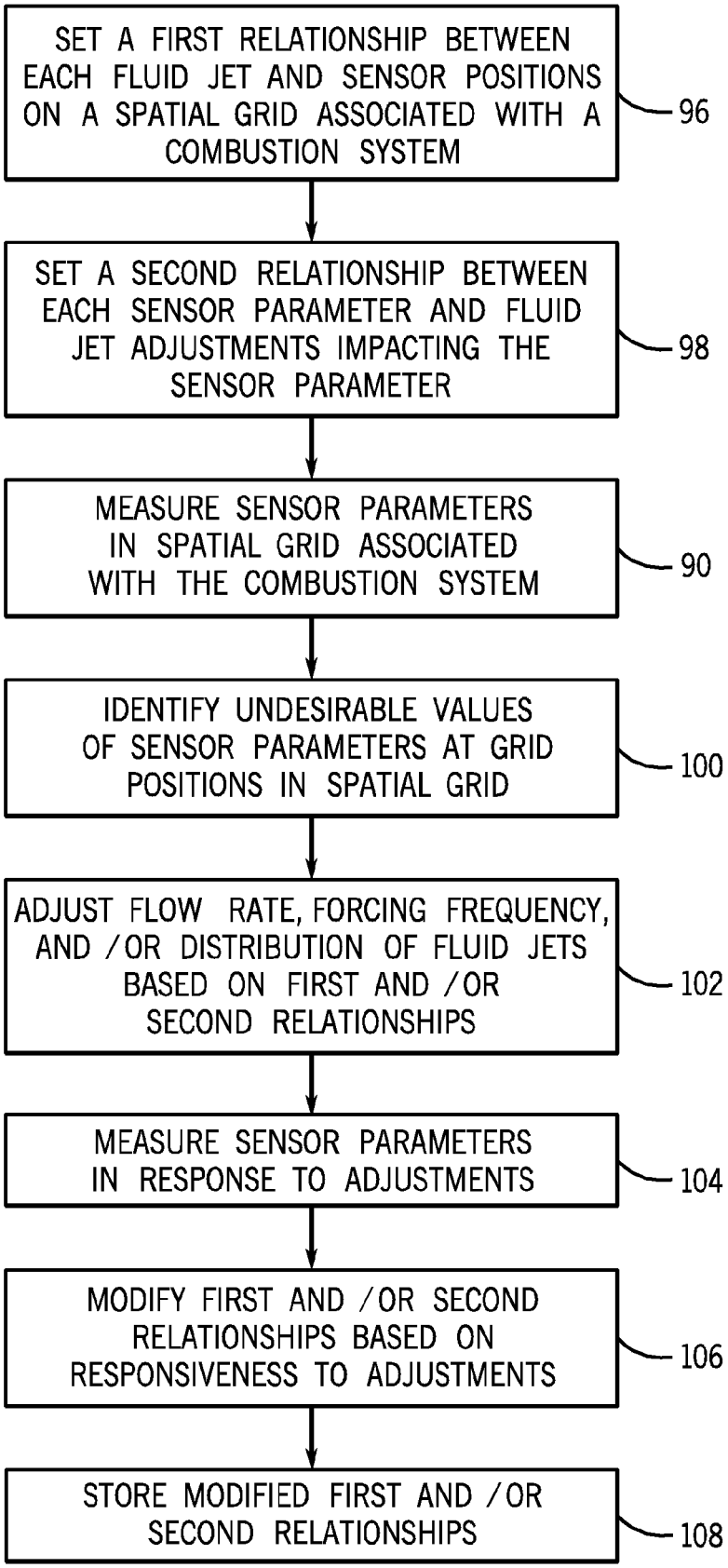
FIG. 5 is a flow chart of a process of controlling combustion and emissions with neural learning in accordance with embodiments of the present invention.

FIG. 5 is a flow chart of a process of controlling combustion and emissions with neural learning in accordance with embodiments of the present invention. Again, the blocks of FIG. 5 represent exemplary logic of neural learning that may be stored and executed with the control system 32 to achieve optimal settings for the boiler system 12. In the illustrated embodiment, the control system 32 sets a first relationship between each fluid jet and each sensor position within the spatial monitoring grid 28, as represented by block 96. For example, the first relationship may be associated with the proximity of the sensors 29 to a particular fluid jet. In certain embodiments, the first relationship may depend on the spacing of adjacent jets, the size of the combustion zone, the spacing of the sensors, and other factors. However, the first relationship may be some spatial region that is affected by changes in a particular fluid jet.

The control system 32 then sets a second relationship between each sensor parameter and the fluid jet adjustments that impact that sensor parameter, as represented by block 98. For example, if the sensor measures temperature or emissions levels, then the fluid jet adjustment may include a variation in flow rate, forcing frequency, forcing amplitude, or a combination thereof, of one or more fluid jets. By further example, if the sensor parameter relates to oxygen or fuel concentration, then the fluid jet adjustment may relate to flow rate of one or more fuel or air jets. Likewise, if the sensor parameter relates to fuel/air mixing, then the fluid jet adjustment may relate to forcing frequency, forcing amplitude, or distribution of fluid jets.

After setting these starting relationships, sensor parameters in the spatial monitoring grid 28 are measured, as represented by block 90. As discussed above, the sensor parameters may include a variety of combustion or emissions parameters. For example, the sensor parameters may include temperature, pressure, velocity, nitrogen oxide (NOx), sulfur oxide (SOx), carbon oxide (CO and $CO_2$), oxygen ($O_2$), volatile organic compound (VOC), total hydrocarbon (THC), particulate matter (PM), moisture, or any combination thereof.

The control system 32 then compares the measured parameters to preset desired values and identifies undesirable values and their associated positions in the spatial monitoring grid, as represented by block 100. The flow rate, forcing frequency and/or distribution of active fluid jets may then be adjusted by the control system 32 based on the first and/or second relationships, as represented by block 102. The control system 32 would then measure sensor parameters in the spatial monitoring grid 28 to evaluate the responses to the adjustments, as represented by block 104. The first and/or second relationships may then be modified based on the responsiveness of the system to the adjustments as indicated by the new sensor measurements, as represented by block 106. Finally, at block 108, the control system 32 stores the modified first and/or second relationships. In this way, the control system 32 may learn how adjustments made to the jets affect emissions and uniform combustion conditions in the boiler system 12.

Figure 6:
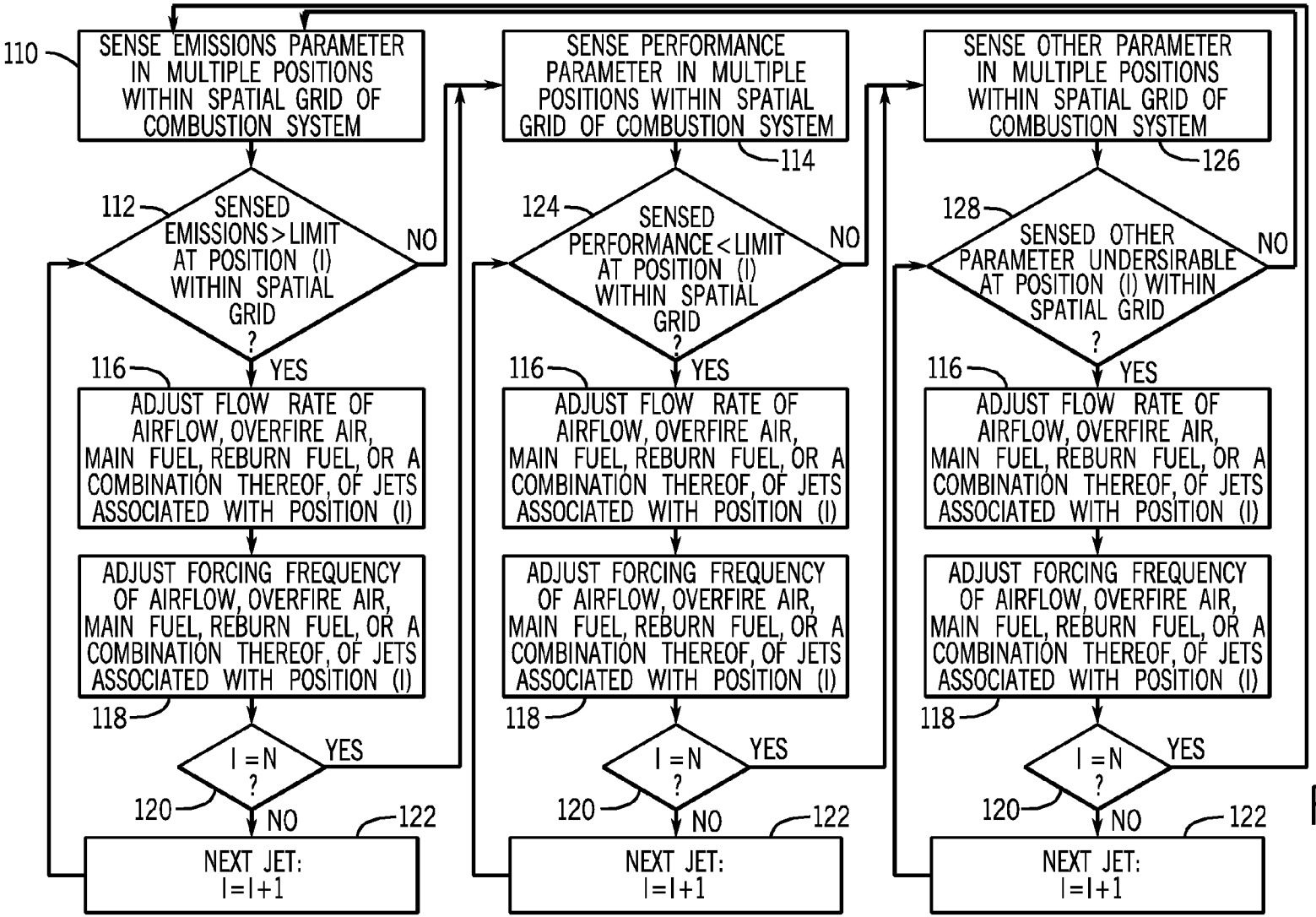
FIG. 6 is a flow chart of a process of controlling combustion and emissions with independent control of each jet in an arrangement of fluid jets based on feedback from a sensor grid in a spatial monitoring system in accordance with embodiments of the present invention.

FIG. 6 is a flow chart of a process of controlling combustion and emissions with independent control of each jet in an arrangement of fluid jets based on feedback from a sensor grid in a spatial monitoring system in accordance with embodiments of the present invention. As illustrated, each block of FIG. 6 represents exemplary logic that may be stored and executed by the control system 32 to optimize combustion via adjustments to individual jets. The logic begins with the sensing of emissions parameters in multiple positions within the spatial monitoring grid 28, as represented by block 110. Emissions parameters may include the concentration or level of emissions, e.g., nitrogen oxide (NOx), sulfur oxide (SOx), carbon oxide (CO and $CO_2$), oxygen ($O_2$), volatile organic compound (VOC), total hydrocarbon (THC), particulate matter (PM), or any combination thereof.

The control system 32 may then compare the sensed emission level at the first position with a preset limit at the first position within the spatial grid, as represented by block 112. If the sensed emission level is not outside of the preset limit, the control system 32 may sense performance parameters in multiple positions within the spatial monitoring grid 28, as represented by block 114. If the sensed emission level is outside of the preset limit, the control system may output a signal for the adjustment of the flowrate of the air 14, overfire air 20, main fuel 16, reburn fuel 18, or a combination thereof, for each jet associated with the sensor position that is outside the preset limit, as represented by block 116. The control system 32 may also adjust the forcing frequency of the air 14, overfire air 20, main fuel 16, reburn fuel 18, or a combination thereof, for each jet associated with the sensor position that is outside the preset limit, as represented by block 118. The control system 32 then checks whether the jet being adjusted is the last of a plurality of jets, as represented by block 120. If the current jet is the last of the plurality of jets, the control system 32 may move on to sense performance parameters in multiple positions within the spatial monitoring grid 28, as represented by block 114. If the current jet is not the last of the plurality of jets, the control system may continue on to the next jet, as represented by block 122, and adjust parameters associated with the next jet as necessary.

Once the final jet of the plurality of jets is adjusted by the control system 32, the control system 32 may proceed to sense performance parameters in multiple positions within the spatial monitoring grid 28, as represented by block 114. The control system 32 may then compare the sensed performance parameter at the first position with a preset limit at the first position within the spatial grid, as represented by block 124. If the sensed performance parameter is not outside of the preset limit, the control system 32 may sense any other relevant parameters in multiple positions within the spatial monitoring grid 28, as represented by block 126. If the sensed performance parameter is outside of the preset limit, the control system may output a signal for the adjustment of the flowrate of the air 14, overfire air 20, main fuel 16, reburn fuel 18, or a combination thereof, for each jet associated with the sensor position that is outside the preset limit, as represented by block 116. The control system 32 may also adjust the forcing frequency of the air 14, overfire air 20, main fuel 16, reburn fuel 18, or a combination thereof, for each jet associated with the sensor position that is outside the preset limit, as represented by block 118. The control system 32 then checks whether the jet being adjusted is the last of a plurality of jets, as represented by block 120. If the current jet is the last of the plurality of jets, the control system 32 may move on to sense other relevant parameters in multiple positions within the spatial monitoring grid 28, as represented by block 126. If the current jet is not the last of the plurality of jets, the control system may continue on to the next jet, as represented by block 122, and adjust parameters associated with the next jet as necessary.

Once the final jet of the plurality of jets is adjusted by the control system 32, the control system 32 may proceed to sense other relevant parameters in multiple positions within the spatial monitoring grid 28, as represented by block 126. The control system 32 may then compare the sensed relevant parameters at the first position with a desirable limit at the first position within the spatial grid, as represented by block 128. If the sensed other parameter is not outside of the desirable limit, the control system 32 may return to block 110 to repeat the process. If the sensed relevant parameter is undesirable as compared to the preset limit, the control system 32 may output a signal for the adjustment of the flowrate of the air 14, overfire air 20, main fuel 16, reburn fuel 18, or a combination thereof, for each jet associated with the sensor position that is undesirable as compared to the preset limit, as represented by block 116. The control system 32 may also adjust the forcing frequency of the air 14, overfire air 20, main fuel 16, reburn fuel 18, or a combination thereof, for each jet associated with the sensor position that undesirable as compared to the preset limit, as represented by block 118. The control system 32 then checks whether the jet being adjusted is the last of a plurality of jets, as represented by block 120. If the current jet is the last of the plurality of jets, the control system 32 may return to block 110 to repeat the process. If the current jet is not the last of the plurality of jets, the control system 32 may continue on to the next jet, as represented by block 122, and adjust parameters associated with the next jet as necessary.

Technical effects of the invention include improved control over combustion and emissions by acoustically forcing, pulsing, vibrating, or modulating various fluid injections in response to sensor feedback in a spatial sensor grid. Thus, the disclosed embodiments may include a controller or a device uniquely programmed with instructions to vary the forcing frequency of one or more fluid jets in response to sensor feedback in the spatial sensor grid. The fluid jets may include fuel jets, air jets, chemical injection jets, or any other suitable liquid or gas jet. The fluid jets may be independently controlled based on the sensor feedback, thereby allowing adjustments to account for spatial variations. As a result, the controller or programmed device may be able to respond to these variations in a manner providing more uniformity in the combustion zone or downstream from the combustion zone.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a combustion system, comprising:

a wall disposed about a combustion zone;

a plurality of fluid paths leading to the combustion zone;

a plurality of fluid jets coupled to the wall in a first spatial distribution, wherein each fluid jet of the plurality of fluid jets is disposed along one of the plurality of fluid paths; and a plurality of forcing frequency drives, wherein each forcing frequency drive of the plurality of forcing frequency drives comprises a signal generator, an amplifier, and a horn or speaker, and wherein each forcing frequency drive of the plurality of forcing frequency drives is coupled to one of the plurality of fluid paths upstream from an outlet of one of the plurality of fluid jets, and each forcing frequency drive of the plurality of forcing frequency drives during operation vibrates or modulates fluid flowing along the respective fluid path each forcing frequency drive is coupled to;

a spatial monitoring system comprising a plurality of sensors disposed in a second spatial distribution within or downstream from the combustion zone; and a control system having a computer-readable memory encoding a first set of instructions that when executed enable the control system to independently control the plurality of forcing frequency drives to adjust a third spatial distribution of a plurality of forcing frequencies applied to fluid expelled from the plurality of fluid jets and a second set of instructions that when executed enable the control system to independently control the plurality of forcing frequency drives to adjust a fourth spatial distribution of a plurality of forcing amplitudes applied to the fluid expelled from the plurality of fluid jets, wherein the control system when in operation in response to sensor feedback from the plurality of sensors indicating spatial variation in one or more combustion parameters in the second spatial distribution executes the first set of instructions, the second set of instructions, or both the first and second sets of instructions.

2. The system of claim 1, wherein the plurality of fluid jets comprises a plurality of fuel jets, a plurality of air jets, or a combination thereof, disposed at different positions in the first spatial distribution of the combustion system.

3. The system of claim 1, wherein the plurality of sensors comprises a plurality of exhaust emissions sensors, a plurality of temperature sensors, a plurality of pressure sensors, a plurality of particulate sensors, a plurality of moisture sensors, a plurality of optical sensors, a plurality of NOx sensors, a plurality of SOx sensors, a plurality of COx sensors, a plurality of NH3 sensors, or a combination thereof, disposed in the second spatial distribution.

4. The system of claim 1, wherein the control system when in operation executes the first set of instructions based on the sensor feedback from the plurality of sensors indicating spatial variation in one or more combustion parameters, a first relationship between at least one fluid jet and the second spatial distribution of the plurality of sensors, and a second relationship between the sensor feedback and the plurality of forcing frequencies impacting the sensor feedback.

5. The system of claim 1, wherein the computer-readable memory encodes a third set of instructions to independently control the plurality of forcing frequency drives to adjust a frequency of pressure pulsations of a fluid flow along each fluid path of the plurality of fluid paths, and the control system when in operation and in response to the sensor feedback from the plurality of sensors indicating spatial variation in one or more combustion parameters in the second spatial distribution from the spatial monitoring system executes the third set of instructions.

6. The system of claim 1, wherein the computer-readable memory encodes a third set of instructions to adjust a fifth spatial distribution of a plurality of fluid flow rates among the plurality of fluid jets, and the control system when in operation and in response to the sensor feedback from the plurality of sensors indicating spatial variation in one or more combustion parameters in the second spatial distribution from the spatial monitoring system executes the third set of instructions.

7. The system of claim 1, wherein the combustion system comprises a boiler having at least one heat exchanger downstream from the combustion zone, wherein the plurality of fluid jets comprises main fuel jets, reburn fuel jets, overfire air jets, chemical agent jets, or a combination thereof.

8. The system of claim 1, wherein the combustion control system to independently control the plurality of forcing frequency drives to spatially vary the plurality of forcing frequencies to provide a non-uniform forcing frequency distribution applied to the fluid expelled from the plurality of fluid jets based on the sensor feedback in the second spatial distribution.

* * * * *